US007106267B2

(12) United States Patent
Chen et al.

(10) Patent No.: US 7,106,267 B2
(45) Date of Patent: Sep. 12, 2006

(54) COAXIAL DIPOLE ANTENNA

(75) Inventors: Si-Han Chen, Taipei Hsien (TW); Zhen-Wei Huang, Taipei Hsien (TW); He-Huan Jin, Taipei Hsien (TW)

(73) Assignee: Elka International Ltd., (TW)

( * ) Notice: Subject to any disclaimer, the term of this patent is extended or adjusted under 35 U.S.C. 154(b) by 31 days.

(21) Appl. No.: 10/997,718

(22) Filed: Nov. 23, 2004

(65) Prior Publication Data

US 2006/0109190 A1 May 25, 2006

(51) Int. Cl.
*H01Q 9/16* (2006.01)

(52) U.S. Cl. ..... 343/792; 343/790; 439/394

(58) Field of Classification Search ..... 343/792, 343/791, 790; 439/394
See application file for complete search history.

(56) References Cited

U.S. PATENT DOCUMENTS 3,576,578 A * 4/1971 Harper ..... 343/791
4,847,626 A * 7/1989 Kahler et al. ..... 343/700 MS
5,506,591 A * 4/1996 Dienes ..... 343/792
5,562,482 A * 10/1996 Wright ..... 439/429
2005/0052327 A1* 3/2005 Posluszny ..... 343/745

* cited by examiner

*Primary Examiner*—Trinh Vo Dinh
(74) *Attorney, Agent, or Firm*—Connolly Bove

(57) ABSTRACT

The coaxial dipole antenna of the present invention has a ground tube made of metal and a coaxial cable. The ground tube has a hollow containing part that the coaxial cable passes through, and an end of the ground tube has a clamping part. The clamping part has a first clamping slice to clamp a jacket of the coaxial antenna and a second clamping slice to clamp a metallic mesh of the coaxial cable. Such coaxial dipole antenna can transmit energy with the coaxial cable. The elements of the coaxial dipole antenna are combined with each other by pressing. Therefore, the coaxial dipole antenna can be manufactured by automation, the product thereof can be increased, and the quality thereof can be controlled.

9 Claims, 5 Drawing Sheets

COAXIAL DIPOLE ANTENNA

BACKGROUND OF THE INVENTION

1. Field of the Invention

This invention relates to a coaxial dipole antenna manufactured with coaxial cable and ground tube through pressing, wherein an upper end is pressed with a jacket and a metallic mesh of the coaxial cable for fixing the cable, grounding, and transmitting energy.

2. Description of the Prior Art

Recently, the combination between electronic devices or between cables is almost conventional welding connection, and the process of antenna also employs welding connection. However, those processes in electronics industry nowadays trend toward unleaded process. Therefore, the conventional structure and process not only cause air pollution, but also break the antenna structure resulted form defective welding or high temperature.

For solving the problems mentioned above, the industries in the field develop low-pollution welding materials as the connecting medium. Unfortunately, any welding materials always causes pollution and hard to maintain in follow-up service, and the yield of finished products will be reduced. Therefore, the cost of welding, check, and product management will increase.

SUMMARY OF THE INVENTION

The main objective of the present invention is to employ press assembly to connect devices. The press assembly can be automatically controlled to achieve product management. Furthermore, the present invention does not use the tin without Heavy metal, so the present invention does not cause environmental pollution and simultaneously conforms to environmental regulation.

DESCRIPTION OF THE PREFERRED EMBODIMENT

Figure 1:
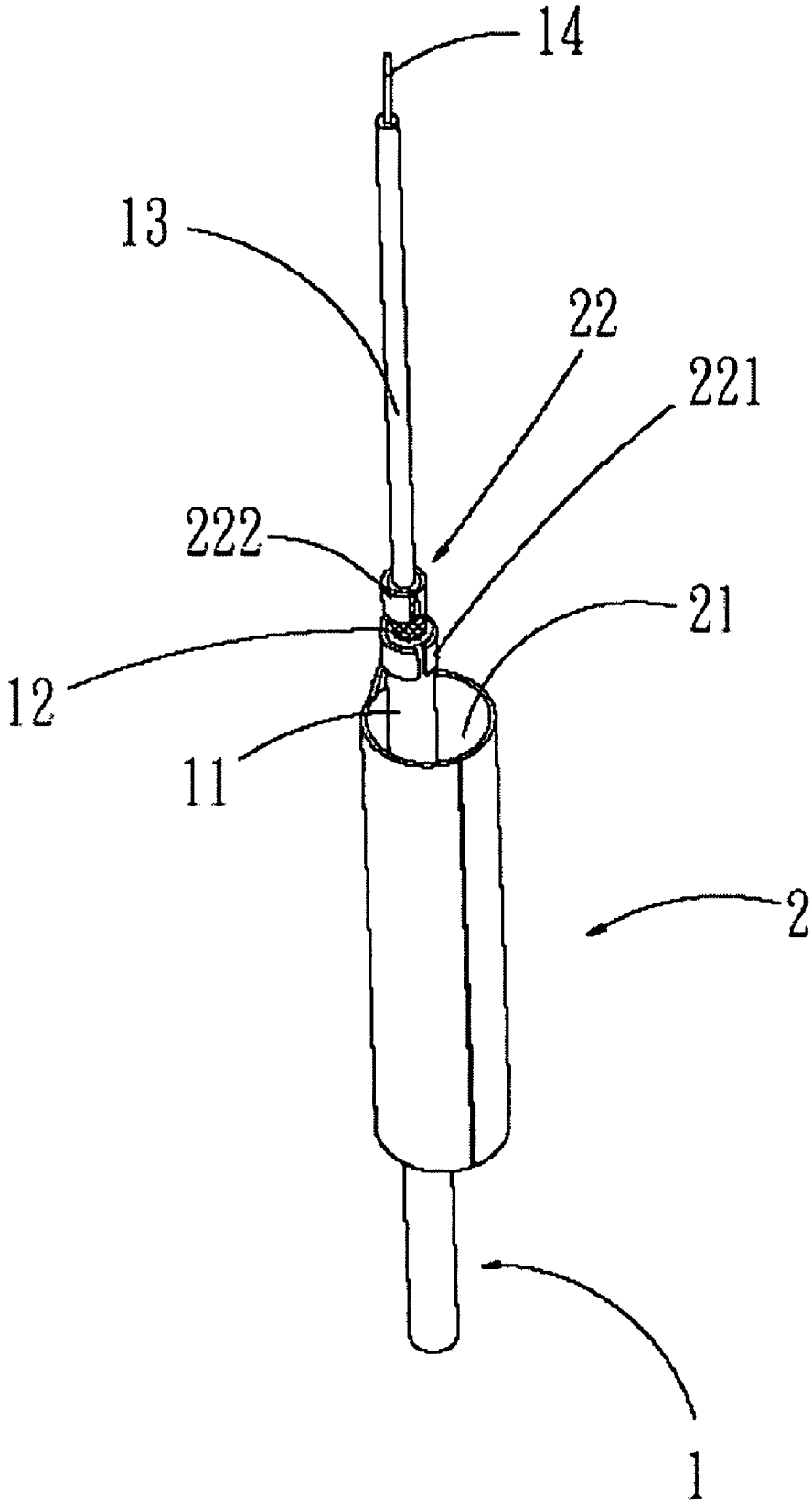
FIG. 1 is a three-dimensional schematic diagram of a first embodiment in the present invention.
Figure 2:
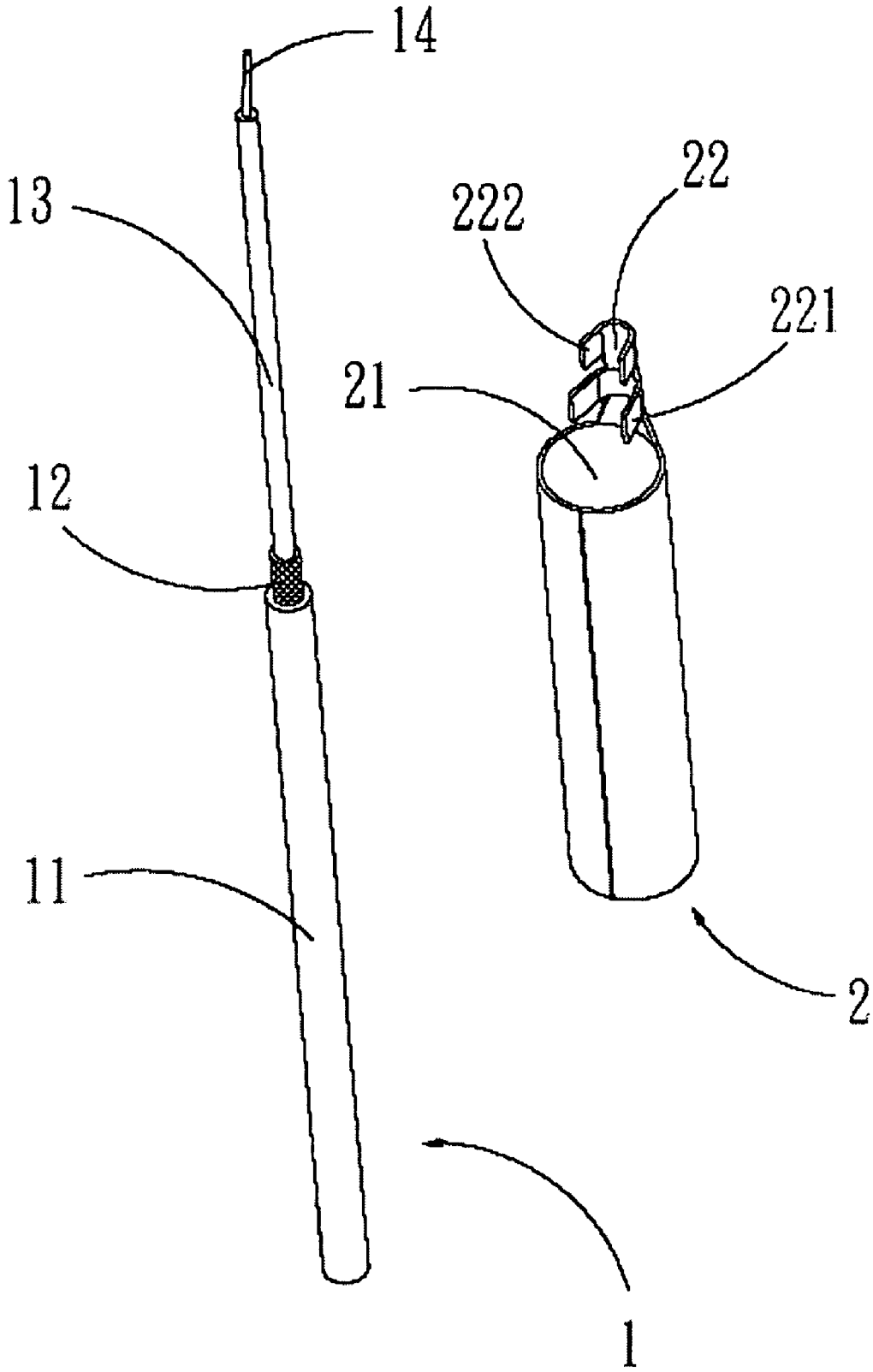
FIG. 2 is a decomposition schematic diagram of a first embodiment in the present invention.

In order to understand objectives, characteristics and advantages of the present invention, the present invention will be described with FIG. 1 and FIG. 2, three-dimensional schematic diagram and decomposition schematic diagram of a first embodiment. As shown in FIG. 1 and FIG. 2, the antenna of the present invention comprises a coaxial cable 1 and a ground tube 2. The coaxial cable 1 has a jacket 11, a metallic mesh 12, an insulation 13, and a central conductor 14. The ground tube 2 is made of metal, and has a hollow containing part 21 through that the coaxial cable 1 passes and a clamping part 22 in an end of the ground tube 2. The clamping part 22 has a first clamping slice 221 to clamp the jacket 11 of the coaxial cable 1 and a second clamping slice 222 to clamp the metallic mesh 12 of the coaxial cable 1. These elements mentioned above are pressed to form the coaxial dipole antenna by stamper.

Figure 3:
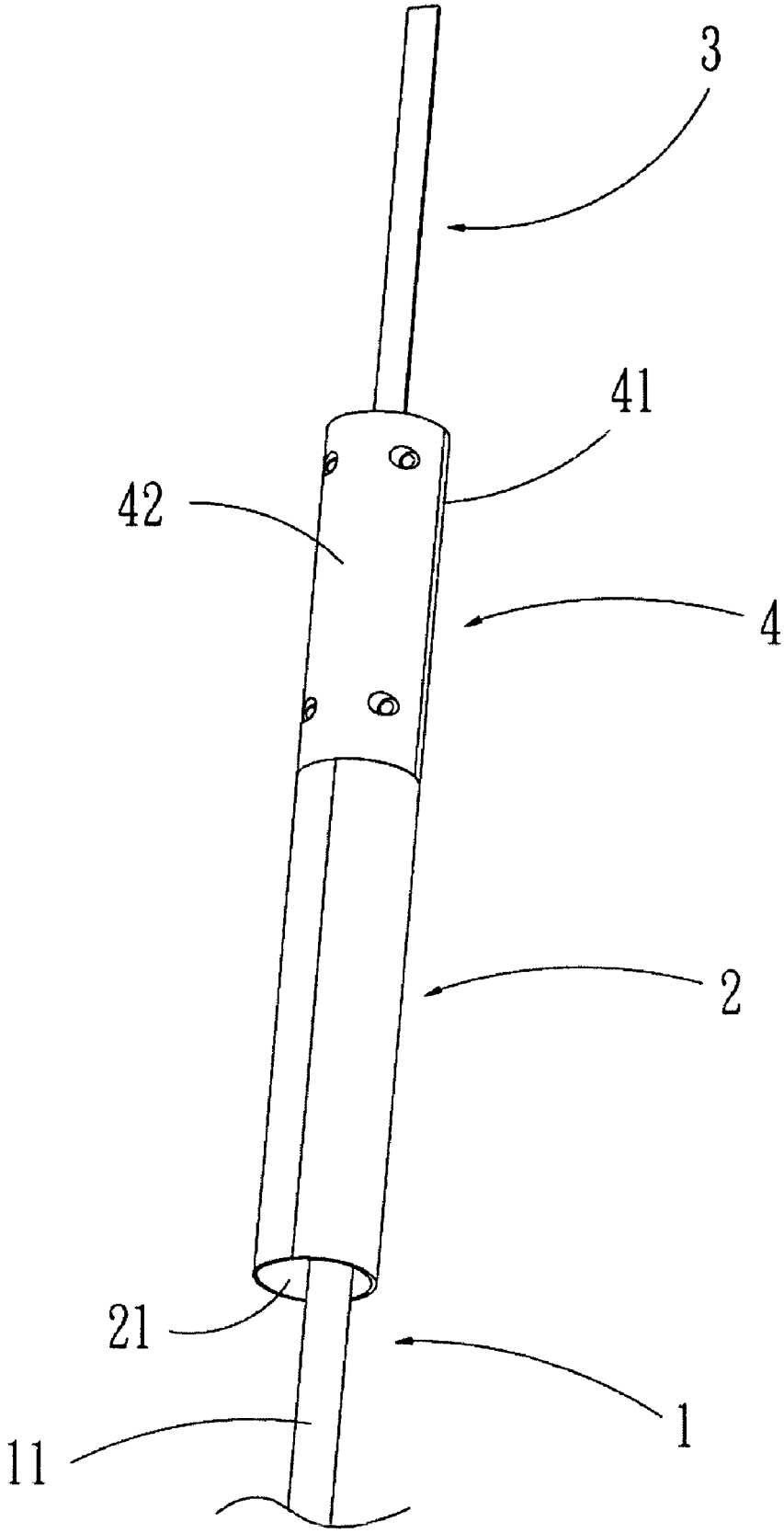
FIG. 3 is a three-dimensional schematic diagram of another embodiment in the present invention.
Figure 4:
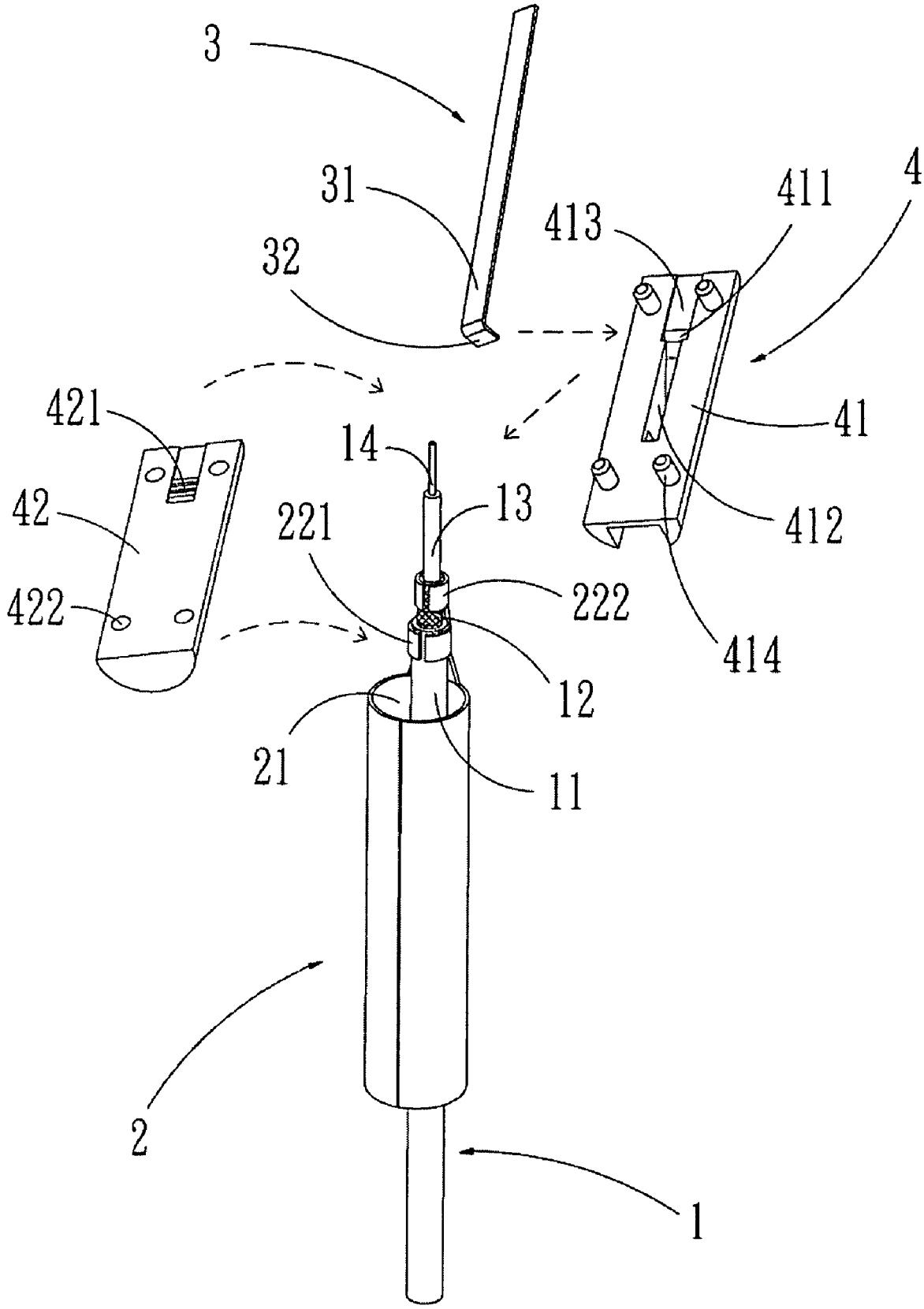
FIG. 4 is a decomposition schematic diagram of another embodiment in the present invention.
Figure 5:
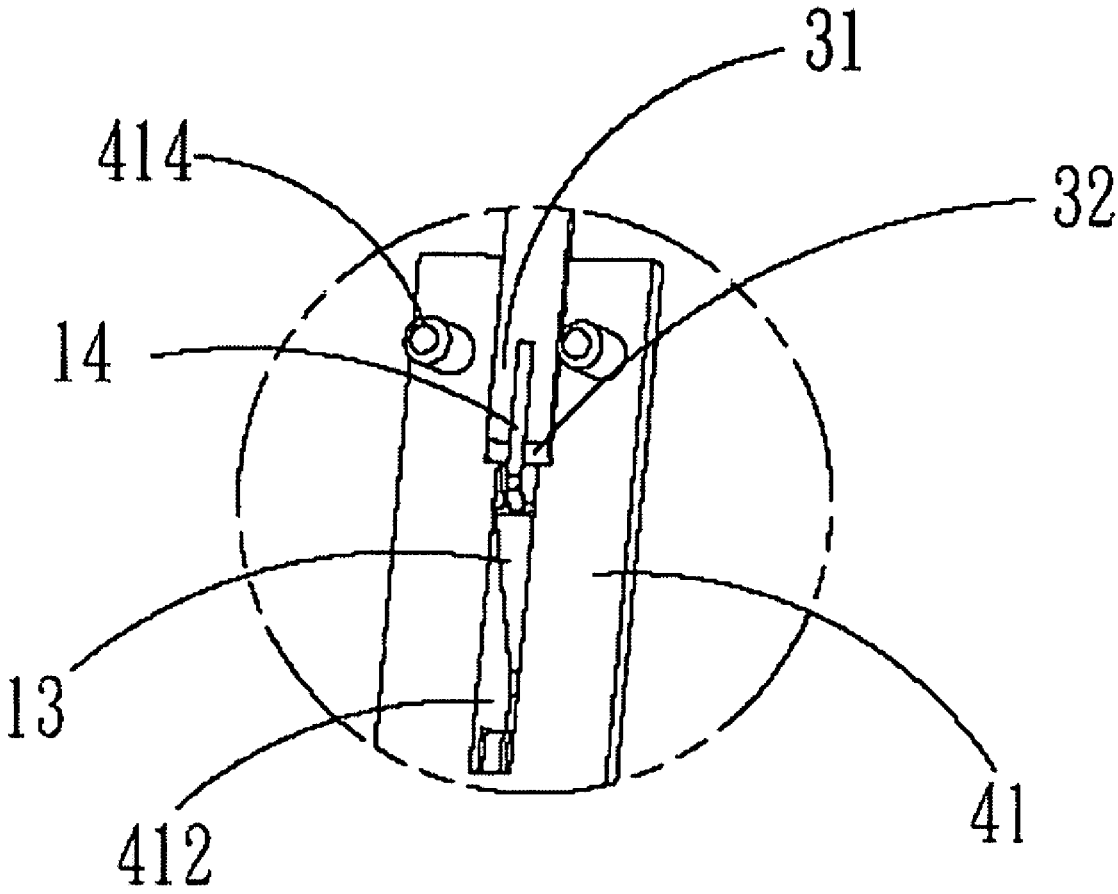
FIG. 5 is a schematic diagram of local portion of another embodiment in the present invention.

An insulator 4 and a metallic conductor 3 can be added into the coaxial dipole antenna of the present invention. Another embodiment of the present invention are shown in FIGS. 3–5, which are a three-dimensional schematic, a diagram decomposition schematic, and a schematic diagram of local portion. The coaxial dipole antenna of the embodiment comprises a coaxial cable 1, a ground tube 2, a metallic conductor 3, and an insulator 4. The coaxial cable 1 has a jacket 11, a metallic mesh 12, an insulation 13, and a central conductor 14. The ground tube 2 is made of metal, and has a hollow containing part 21 through that the coaxial cable 1 passes and a clamping part 22 in an end of the ground tube 2. The clamping part 22 has a first clamping slice 221 to clamp the jacket 11 of the coaxial cable 1 and a second clamping slice 222 to clamp the metallic mesh 12 of the coaxial cable 1. These elements mentioned above are pressed to form the coaxial dipole antenna by stamper. The metallic conductor 3 has a contact part 31 electrically connecting to a central conductor 14 of the coaxial cable 1 and a buckle 32 in a curved portion. The insulator 4 has a base 41 and a cover 42. The base 41 has a groove 4 to combine with the buckle 32 of the metallic conductor 3, a trench 412 through that the coaxial cable 1 passes, and a supporter to support the metallic conductor 3. The cover 42 has a pressing 421 to press the coaxial cable 1 and the metallic conductor 3 to form electrical connection.

In such case, the base 41 and the cover 42 are tightly combined by using a high frequency wave. Alternatively, a predetermined amount of connecters (414, 422) are formed on the base 41 and the cover 42. The connecters (414, 422) can be cylinders and casing pipes, wherein an outside diameter of the cylinder is slightly larger than an aperture of the casing pipe to form tightening effect there between, and therefore a coaxial dipole antenna is formed.

Hence, the coaxial dipole antenna of the present invention is manufactured with coaxial cable and ground tube by press assembly, and complete elements thereof are assembled through pressing. The cable can be fixed, and the coaxial dipole antenna can ground and transmit energy. Because the elements of the coaxial dipole antenna are combined with each other by pressing, the coaxial dipole antenna can be manufactured by automation. Therefore, the product thereof can be increased, and the quality thereof can be controlled. Accordingly, the coaxial dipole antenna of the present invention overcomes the drawback of the conventional antenna.

Although specific embodiments have been illustrated and described, it will be obvious to those skilled in the art that various modifications may be made without departing from what is intended to be limited solely by the appended claims.

What is claimed is:

1. A coaxial dipole antenna comprising:

a coaxial cable;

a ground tube made of metal, said ground tube having a hollow containing part that said coaxial cable passes through and an end of said ground tube having a clamping part to fix said coaxial cable;

a metallic conductor having a contact part electrically connecting to a central conductor of said coaxial cable;

an insulator having a base and a cover to press said coaxial cable and said metallic conductor to form electrical connection.

2. The coaxial dipole antenna according to claim 1, wherein said clamping part has a first clamping slice to clamp a jacket of said coaxial antenna and a second clamping slice to clamp a metallic mesh of said coaxial cable.

3. The coaxial dipole antenna according to claim 1, wherein said metallic conductor has a buckle in a curved portion thereof.

4. The coaxial dipole antenna according to claim 3, wherein said base has a groove to combine with said buckle of said metallic conductor.

5. The coaxial dipole antenna according to claim 1, wherein said base has a trench said coaxial cable passing through and a supporter to support said metallic conductor.

6. The coaxial dipole antenna according to claim 1, wherein said cover has a pressing to press said coaxial cable and said metallic conductor to form electrical connection.

7. The coaxial dipole antenna according to claim 1, wherein said base and said cover are tightly combined.

8. The coaxial dipole antenna according to claim 1, wherein said base and said cover have a predetermined amount of connecters thereon.

9. The coaxial dipole antenna according to claim 8, wherein said connecters are cylinders and casing pipes, and an outside diameter of said cylinder is slightly larger than an aperture of said casing pipe to forming tightening effect there between.

* * * * *